US008733930B2

(12) United States Patent
Felten et al.

(10) Patent No.: US 8,733,930 B2
(45) Date of Patent: May 27, 2014

(54) LENS DEBLOCKING METHOD AND RELATED DEVICE

(75) Inventors: Yohann Felten, Charenton le Pont (FR); Matthieu Le Gall, Charenton le Pont (FR)

(73) Assignee: Essilor International (Compagnie Generale d'Optique), Charenton Le Pont (FR)

( * ) Notice: Subject to any disclaimer, the term of this patent is extended or adjusted under 35 U.S.C. 154(b) by 27 days.

(21) Appl. No.: 13/508,988

(22) PCT Filed: Oct. 19, 2010

(86) PCT No.: PCT/EP2010/065716

§ 371 (c)(1),
(2), (4) Date: May 9, 2012

(87) PCT Pub. No.: WO2011/054665

PCT Pub. Date: May 12, 2011

(65) Prior Publication Data

US 2012/0224140 A1 Sep. 6, 2012

(30) Foreign Application Priority Data

Nov. 9, 2009 (EP) ..... 09306073

(51) Int. Cl.

| | |
|---|---|
| ***G02C 7/02*** | (2006.01) |
| ***G02C 5/00*** | (2006.01) |
| ***B24B 13/005*** | (2006.01) |

(52) U.S. Cl.
USPC ..... 351/159.73; 351/178; 451/384

(58) Field of Classification Search
USPC ..... 351/159.73; 451/384
See application file for complete search history.

(56) References Cited

U.S. PATENT DOCUMENTS

| | | | | |
|---|---|---|---|---|
| 4,328,060 | A | 5/1982 | Tusinski et al. | |
| 5,520,568 | A * | 5/1996 | Craighead et al. | 451/42 |
| 6,036,313 | A * | 3/2000 | Benjamin et al. | 351/159.01 |
| 6,074,290 | A | 6/2000 | Ko et al. | |
| 6,126,528 | A * | 10/2000 | Sedlock | 451/390 |
| 2011/0031637 | A1 | 2/2011 | Felten et al. | |

FOREIGN PATENT DOCUMENTS

| | | |
|---|---|---|
| EP | 1 997 586 | 12/2008 |
| FR | 2 847 189 | 1/2006 |

* cited by examiner

*Primary Examiner* — Evelyn A Lester
*Assistant Examiner* — William Alexander
(74) *Attorney, Agent, or Firm* — Cozen O'Connor

(57) ABSTRACT

A method of deblocking an ophthalmic lens component (100) blocked on a thermoplastic layer (310) arranged on the holding surface (210) of a lens holding block (200) comprising the step of applying a pushing force on the thermoplastic layer (310), wherein the pushing force is greater or equal to 100 N and smaller or equal to 1000 N and wherein the pushing force is applied in a region of the thermoplastic layer (310) situated at a distance of at least 17.5 mm from the fitting point or prism reference point of the ophthalmic lens component (100).

14 Claims, 2 Drawing Sheets

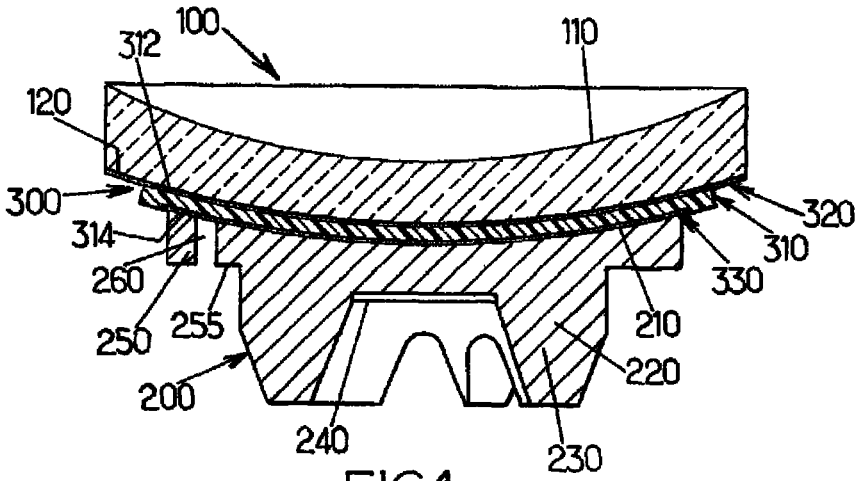
FIG.1.
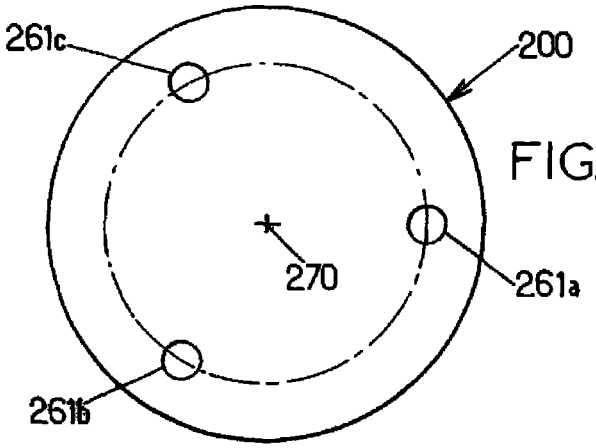
FIG.2.
FIG.3.
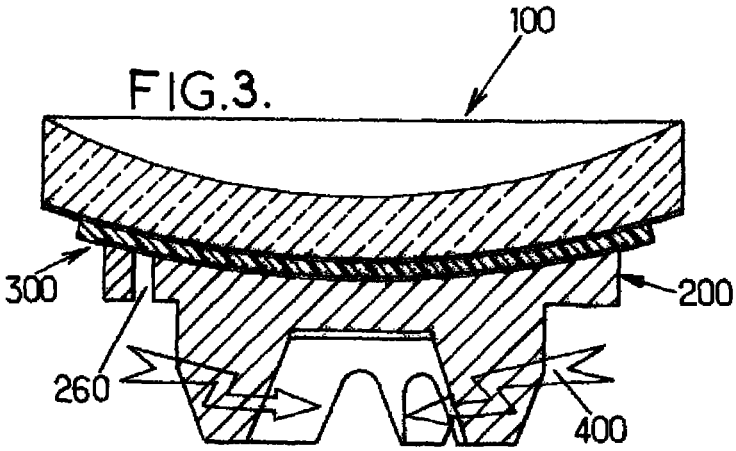

LENS DEBLOCKING METHOD AND RELATED DEVICE

RELATED APPLICATIONS

This is a U.S. National Phase Application under 35 USC 371 of International Application PCT/EP2010/065716 filed on Oct. 19, 2010.

This application claims the priority of European application no. 09306073.9 filed Nov. 9, 2009, the entire content of which is hereby incorporated by reference.

FIELD OF THE INVENTION

This invention relates to a lens blocking and deblocking method and device for use in adhering an ophthalmic lens to a lens holding block employed with conventional machining, grinding and processing equipment in the generation of ophthalmic lenses.

BACKGROUND OF THE INVENTION

The process of preparing optical or ophthalmic lenses begins with an unfinished or semi-finished glass or plastic lens blank. Typically a semi-finished lens blank has a finished polished front surface and an unfinished back surface. By grinding away material from the back surface of the lens blank the required corrective prescription is generated. Thereafter the surface having had the corrective prescription imparted thereto is polished and the peripheral edge of the thus processed lens blank is provided with a final desired contour thereby establishing a finished optical or ophthalmic lens. The lens blank can be either a plastic or a glass lens blank.

During these various processing operations the lens blank is securely maintained in accurate alignment and in place on a lens holding block. This procedure is often referred to as "lens blocking".

Various materials are employed to secure the lens blank to the lens holding block. These materials include glues, pitch and low temperature fusible metal alloys. The use of glues and pitch, in addition to being messy, suffers the further disadvantage of generally being non-reusable or non-reclaimable. While the prior art use of low temperature metal alloys eliminated some of these disadvantages experienced with the use of glues and pitch, nonetheless, the use of these metal alloys, both in their preparation and their reclamation caused significant environmental and health hazards especially since these alloys were most often fabricated from such metals as cadmium, tin, lead and bismuth. Of these metals, lead and cadmium are the most toxic. Lead is strong protoplasmic poison and can be introduced into the body by ingestion, inhalation and skin absorption. Cadmium poisoning is similar to lead in many ways and is introduced into the body in the same way as lead. Like lead, cadmium is stored in the liver, kidney and bone. Procedures for the formulation of such alloys and reclamation processes so as to enable its re-use as a material to secure a lens blank to a lens holding block thus exposes workers to serious environmental and health hazards. The formation of these alloys often is accomplished through the use of powdered or particulate metals which are subjected to a sintering and heat treating process. Fumes and/or dust particles of these metals are released to the ambient atmosphere thereby creating environmental and health hazards for those formulating these alloys. The same hazards exist for those attempting to reclaim the used low temperature metal alloy blocking material.

To overcome these issues, organic low shrinkage materials have been developed to be used as lens blocking materials.

U.S. Pat. No. 6,036,313 in the name of 3M Innovative Properties Company discloses examples of compound families suitable for lens blocking with thermoplastic materials.

The disclosed blocking compositions have many advantages over traditional metal alloy materials. For example, the lens blocking compositions are non-toxic, environmentally safe, and preferably biodegradable. The materials preferably can be used with existing processing equipment and may be recycled. An ophthalmic lens holding block can be used that comprises a solidified mass of a thermoplastic blocking composition. The blocking composition may comprise a homopolymer or copolymer of epsilon-caprolactone, and preferably has a number average molecular weight of at least 3,000, a mean bending modulus of at least 69 MPa at 21° C., or a mean flexural strength of at least 1 MPa at 21° C. The composition is solid at 21° C. and has a sufficiently low melting or softening point such that the composition may be placed adjacent to an ophthalmic lens blank while at its melting or softening point without damaging the lens blank. The composition also has sufficient adhesion to a lens blank or to a lens blank coating or tape to hold an ophthalmic lens during a generating procedure.

U.S. Pat. No. 6,036,313 discloses a method of holding an ophthalmic lens blank, comprising the steps of:

- providing a lens blocking composition as described above;
- heating the lens blocking composition to its melting or softening point;
- providing a blocking material receiving cavity against the lens blank;
- forming the ophthalmic lens blocking composition into the receiving cavity; and allowing the composition to solidify.

Alternatively, a method of holding an ophthalmic lens blank is described, comprising the steps of:

- providing an ophthalmic lens block comprising a solidified mass of a thermoplastic blocking composition, and preferably comprising a heat absorbing material;
- heating the surface of the lens blocking composition to its melting or softening point;
- positioning a lens blank against the softened surface of the lens blocking composition; and allowing the composition to resolidify.

However the inventors have noticed that separating the thermoplastic blocking composition from the lens blank or from the lens blank tape or coating is an issue. This deblocking step comprises ordinarily a hammering step and a crack is generated at the interface between the thermoplastic blocking composition and the lens blank or the lens blank tape or coating.

Said step needs an operator, is often made after separating the ophthalmic lens block from the grinding machine, is time consuming and may introduce defects on the final lens.

SUMMARY OF THE INVENTION

Accordingly there remains a need for improving deblocking of a lens component, either a sole lens blank or a coated or tape covered lens blank, fixed on a thermoplastic block of an ophthalmic lens block.

Thus, one object of the present invention is to improve the deblocking step to enhance the quality of resulting lens.

This object is obtained according to one aspect of the invention by a method of deblocking an ophthalmic lens component blocked on a thermoplastic layer arranged on the holding surface of a lens holding block comprising the step of applying a pushing force on the thermoplastic layer, wherein the pushing force is greater or equal to 100 N and smaller or equal to 1000 N and wherein the pushing force is applied in a region of the thermoplastic layer situated at a distance of at least 17.5 mm from the fitting point or prism reference point of the ophthalmic lens component.

In the senses of the invention, the "fitting point" corresponds to a point on the front surface of the ophthalmic lens component stipulated by the manufacturer as a reference point for positioning the lens in front of the eye, as indicated in the international standard ISO 13666:1998.

In the sense of the invention, the "prism reference point" corresponds to a point on the front surface of the ophthalmic lens component stipulated by the manufacturer at which the prismatic effect of the finished lens is determined, as indicated in the international standard ISO 13666:1998.

Advantageously, the pushing force is applied in a region of the thermoplastic layer that is in contact with the external part of the ophthalmic lens. The external part of the ophthalmic lens corresponds to the part of the ophthalmic lens that is of less interest in term of optical function. Indeed, before mounting the ophthalmic lens on spectacle frame, the ophthalmic lens after being edged is centered in the spectacle frame.

Advantageously, according to the deblocking method of the invention, the pushing force is applied in a region of the ophthalmic lens component that is of low ophthalmic value. That is in a region that is not to be placed directly in front of the wearer's eyes.

According to further embodiments which can be considered alone or in combination,

- the method further comprises prior to or when applying the pushing force a step of warming the thermoplastic layer at a temperature greater or equal to 30° C. and smaller or equal to 70° C.,
- the pushing force is applied on the thermoplastic layer so as to have the moment applied to the ophthalmic lens component smaller or equal to 3.5 N·m, for example smaller or equal to 2.4 N·m,
- the pushing force is obtained by moving at least one pin through at least one hole in the lens holding block to contact the thermoplastic layer and by further moving the pin to push the thermoplastic layer,
- the pushing force is obtained by moving the lens holding block so as to have at least one pin enter into at least one hole in the lens holding block to contact the thermoplastic layer and by further moving the lens holding block to push the thermoplastic layer,
- the ophthalmic lens component is a sole ophthalmic lens blank or the ophthalmic lens component is a lens blank and a coating or tape applied to the ophthalmic lens blank surface close to the thermoplastic layer,
- a tape is placed between the thermoplastic layer and the holding surface of a lens holding bloc, and
- the melting or softening point of the thermoplastic of the thermoplastic layer is greater or equal to 35° C. and smaller or equal to 75° C.

Another aspect of the invention relates to a method of machining a lens component comprising the steps of:

- providing a lens holding block and a thermoplastic layer,
- heating the thermoplastic layer to a temperature at which at least a part of the thermoplastics flows under moderate pressure,
- placing the ophthalmic lens component onto the thermoplastic layer,
- allowing the thermoplastic layer flown part to solidify, thereby adhering the ophthalmic lens component,
- machining the ophthalmic lens component,
- deblocking the ophthalmic lens component according to the method of the invention.

Another aspect of the invention relates to an lens holding block comprising a thermoplastic layer used to allow an ophthalmic lens component to be blocked on it wherein the lens holding block is provided with at least one hole arranged to receive a moving pin and wherein the hole is positioned at least 17.5 mm from the center of the lens holding block.

According to further embodiments of the lens holding block comprises one or any combination of the following features:

- the lens holding block comprises three holes placed at equal distances from the center of the lens holding block at an angle substantially equal to 120°, and wherein the distance between each of the three holes and the center the lens holding block is greater or equal to 20 mm,
- the distance between the at least one hole and the center the lens holding block is smaller or equal to 24 mm,
- the at least one hole has a cylindrical shape and a diameter greater or equal to 3 mm and smaller or equal to 5 mm, and
- the melting or softening point of the thermoplastic of the thermoplastic layer is greater or equal to 35° C. and smaller or equal to 75° C.

Another aspect of the invention relates to a lens blocking device comprising a lens holding block according to the invention and at least one pins arranged to be entered in the hole of the lens holding block so as to apply a force greater or equal to 100 N and smaller or equal to 1000 N to the thermoplastic layer.

BRIEF DESCRIPTION OF THE DRAWINGS

Non limited embodiments of the invention will now be described with reference to the accompanying drawing wherein:

FIG. 1 is a cross sectional view of an ophthalmic lens component fixed on a lens holding block according to an embodiment of the present invention;

FIG. 2 is a schematic representation of an upper view of an lens holding block according to an embodiment of the invention, FIGS. 3 to 5 show successive steps of a deblocking method according to the present invention.

Figure 4:
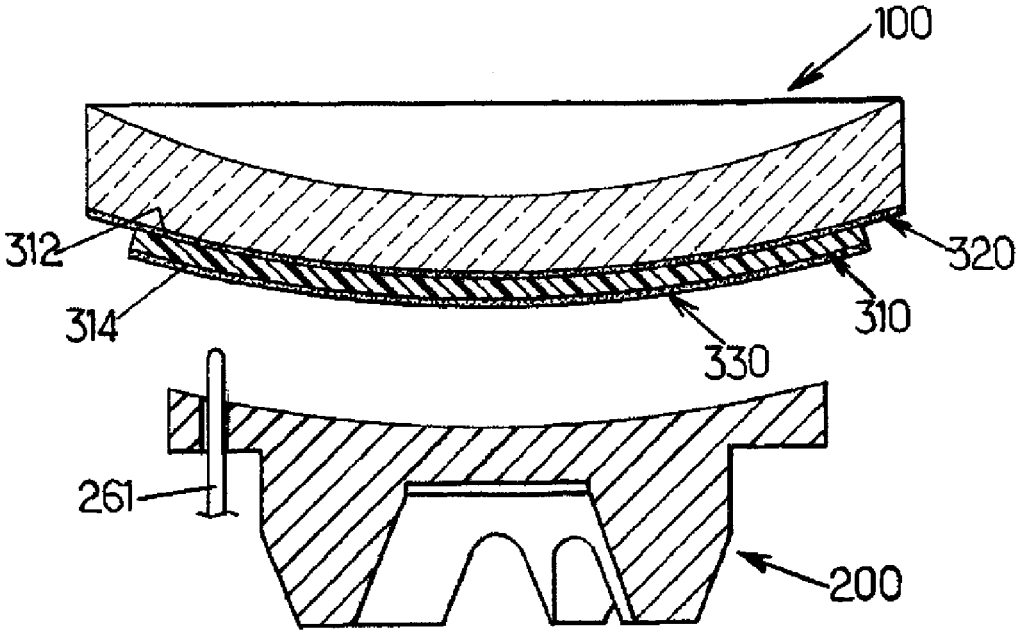

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION OF THE DRAWINGS

The wording "upper" or "on" and "bottom" or "under" indicates positions relative to the ophthalmic lens component when it is arranged so as the edge of the ophthalmic lens component to be machined is substantially situated in a horizontal plane.

Said position is purely conventional and the ophthalmic lens component can be machined in a non horizontal position.

As shown on FIG. 1, an ophthalmic lens component 100 is secured on a lens holding block 200 thanks to fixing means 300. The edge of the ophthalmic lens component 100 is substantially situated in a horizontal plane.

The upper surface 110 of the ophthalmic lens component 100 is a surface to be machined, as for an example to be grinded and/or polished. The ophthalmic lens component 100 can be further edged.

The bottom surface 120 of the ophthalmic lens component 100 contacts the upper surface of the fixing means 300.

According to the present invention, an "ophthalmic lens component" may be an ophthalmic lens which surfaces have already been machined, a semi-finished ophthalmic lens blank with a polished front surface, an ophthalmic lens blank with two unfinished surfaces.

The ophthalmic lens component can be made for example, but not limited to, of plastic or glass. More generally, any combination of material suitable to obtain an optical system may be used. One or two surfaces of the optical lens may be coated.

Thus an "ophthalmic lens component" of the invention can be every optical part that needs to be machined, as for example to be cut and/or grinded and/or polished and/or edged and/or engraved, in order to provide a machined ophthalmic lens.

A fully machined ophthalmic lens according to the present invention is for example an ophthalmic lens which surfaces form an optical system that fits a desired prescription. Said machined ophthalmic lens can be edged when blocked according to the present invention or edged in a further processing step, as for an example edged by an eye care practitioner.

According to an embodiment, the ophthalmic lens component 100 is a semi-finished lens blank and the bottom surface 120 is a finished optical surface.

As for an example, the external diameter of the ophthalmic lens component 100 is between 50 mm and 100 mm, for example equal to 80 mm.

The lens holding block 200 is a block, for example metallic, which comprises a bottom part 230, 220 and an upper part 250.

The lower part 230 of bottom part comprises means to orientate the lens holding block 200 in corresponding orientating means of a tool (not represented) of a lens machining unit such as a lathe or another movement inducing machine. The tool may be a chuck or another fixing tool.

Internal surface 240 of the lens holding block 200 may contact an upper surface of the tool.

The bottom part of the lens holding block 200 also comprises a central part 220 which is a cylindrical part to be squeezed by the fixing tool of the machining unit.

Upper part 250 has an external diameter larger than the diameter of the central part 220 and its bottom surface 255 may lay on the upper surface of the tool of the lens machining unit and may comprise positioning means. The upper part 250 also comprises a holding surface 210.

According to an embodiment of the invention, the upper part 250 of the lens holding block 200 may comprise a hole 260 emerging on the upper assembling surface 210.

The hole 261 represented on FIG. 1 has a circular section, but other hole sections are also suitable, such as elliptic or square sections.

According to an embodiment of the invention, the lens holding block may be heat conducting and can be a metallic part or any material suitable to let the heat propagate through said material. According to an embodiment of the present invention, the holding unit is made of aluminium alloy.

According to an embodiment of the invention, the fixing means 300 may be are arranged between the holding surface 210 and the bottom surface 120 of the ophthalmic lens component 100 and consists of three stacked layers where:

the first layer is an adhesive tape 330 which bottom surface 334 is fixed on upper assembling surface 210;

the second layer is a thermoplastic layer 310 of thermoplastic material which bottom surface 314 is arranged on the upper surface 332 of the adhesive tape 330;

the third layer is an adhesive tape 320 which bottom surface 324 is arranged on the upper surface 312 of the layer 310 of thermoplastic material;

the bottom surface 120 of the ophthalmic lens component 100 is fixed on the upper surface 322 of the adhesive tape 320.

According to the present invention, a "thermoplastic layer" is a layer of material which comprises at least a thermoplastic material. A thermoplastic material can be remelted or soften when being heated and remolded when cooling after melting or softening. Most thermoplastics are high molecular weight polymers whose chains associate through weak van der Waals forces (polyethylene); stronger dipole-dipole interactions and hydrogen bonding (nylon); or even stacking of aromatic rings (polystyrene). Many thermoplastic materials are addition polymers; e.g., vinyl chain-growth polymers such as polyethylene and polypropylene. The thermoplastic inorganic material may comprise additives (such as, for example, plasticizers, stabilizers, pigments, . . . ) and/or fillers (such as mineral and/or organic fillers, as for examples boron, carbon, clay, glass, cellulose, metals, oxides, aramide, polyamide, . . . ; fillers may be of different geometry, such as for example grains, lamella, short or long fibers, . . . ).

European patent application EP08305794 discloses thermoplastic materials that may be used for the thermoplastic layer.

According to an embodiment, the adhesive tapes 320, 330 have a pressure-sensitive adhesive surface and a tack-free adhesion promoting surface. The tapes 320, 330 assist in the firm bonding of the optical lens 100 to the thermoplastic material layer 310 and to the holding unit assembling surface 210.

According to an embodiment, the tapes are conformable, that is, they follow the curvature of the lens blanks without any wrinkles or air bubbles; and translucent, that is, they permit light to pass there through. As a result, the lens may be visually aligned in the appropriate device prior to blocking. Still further, when the tapes are removed from the lens, they leave virtually no adhesive residue. Thus, messy and time consuming cleaning operations need not be performed on the lens before it can be used.

Despite this clean removability, suitable tapes may exhibit excellent adhesion to the optical lens, to the thermoplastic material and to the holding unit. Additionally, the tapes may be able to withstand the shear forces encountered during the machining operations. As a result, lenses are held in accurate position throughout these operations. An added benefit offered by using an adhesive tape is the protection provided to the optical lenses from thermal and mechanical shock.

The composition of the exposed surface of the tape (i.e., the non-adhesive surface away from the optical lens or from the upper assembling surface of the holding unit) may be selected so as to achieve the desired degree of adhesion with a particular thermoplastic material.

Examples of suitable tapes are given in previously cited U.S. Pat. No. 6,036,313.

As for examples, tapes commercialized by the company 3M and referred as 1640 and 1641 are particularly suitable.

A 1641 adhesive tape commercialized by the company 3M comprises a baking made of polyethylene film covered by an acrylate adhesive.

According to an embodiment of the present invention, the upper surface 21 of the thermoplastic block 2 is heated, for example with UV or IR lamps, so as to let a thin blocking material zone melt or soften. The lens component 1 is then placed onto said molten or softened zone and moderate pressure is applied onto the lens component. The lens component is securely blocked after the cooling of the blocking material and the lens blank is machined using conventional tools to provide grinding and/or polishing and/or edging.

After machining the ophthalmic lens component, it is deblocked and detached from the blocking material.

According to the invention, the ophthalmic lens component is deblocked by applying a pushing force on the thermoplastic layer, wherein the pushing force is greater or equal to 100 N and smaller or equal to 1000 N and wherein the pushing force is applied in a region of the thermoplastic layer situated at a distance of at least 17.5 mm, for example at least 20 mm, for example at least 21.5 mm, for example 24 mm, from the fitting point or prism reference point of of the ophthalmic lens component.

According to an embodiment of the invention, prior to or when applying the pushing force the deblocking method of the invention may further comprise a step of warming the thermoplastic layer at a temperature greater or equal to 30° C. and smaller or equal to 70° C.

Advantageously, warming the thermoplastic prior to or when applying the pushing force allows to reduce the intensity of the pushing force and the risk of deforming the ophthalmic lens component during the deblocking step.

According to an embodiment of the invention, the pushing force is applied on the thermoplastic layer so as to have the moment applied to the ophthalmic lens component smaller or equal to 3.5 N·m, example smaller or equal to 2.4 N·m, for example smaller or equal to 0.35 N·m.

Advantageously, applying a moment smaller or equal to 3.5 N·m, for example smaller to 0.35 N·m, to the ophthalmic lens component allows reducing the stress applied to the ophthalmic lens component during the deblocking method. Reducing the stress applied to the ophthalmic lens component reduces the risk of damaging the ophthalmic lens during the deblocking. Indeed, the inventors have observed that when a strong moment is applied to the ophthalmic lens component the surface of the ophthalmic lens may be deformed.

According to the invention, the pushing force may be obtained by any pushing means known from the person skilled in the art. The pushing force may be obtained for example by injecting a gas under pressure in the hole 260.

According to an embodiment of the invention, the pushing force is obtained by moving a pin 261 through the hole 260 in the lens holding block 200 to contact the fixing means 300 and by further moving the pin 261 to push the fixing means.

According to an embodiment of the invention, the pushing force is obtained by moving the lens holding block so as to have the pin 261 enter into the hole 260 in the lens holding block 200 to contact the fixing means 300 and by further moving the lens holding block to push the fixing means 300.

According to an embodiment of the invention represented on FIG. 2, the lens holding block 200 comprises three holes 261*a*, 261*b*, 261*c*, placed at equal distances from the center 270 of the lens holding block 200 at an angle substantially equal to 120°.

Each of the three holes has a circular section of a diameter greater or equal to 2 mm and smaller or equal to 6 mm, for example equal to 4 mm.

The three holes are at a distance of the center 270 of the lens holding block 200 greater or equal to 20 mm, for example equal to 24 mm.

Figure 5:
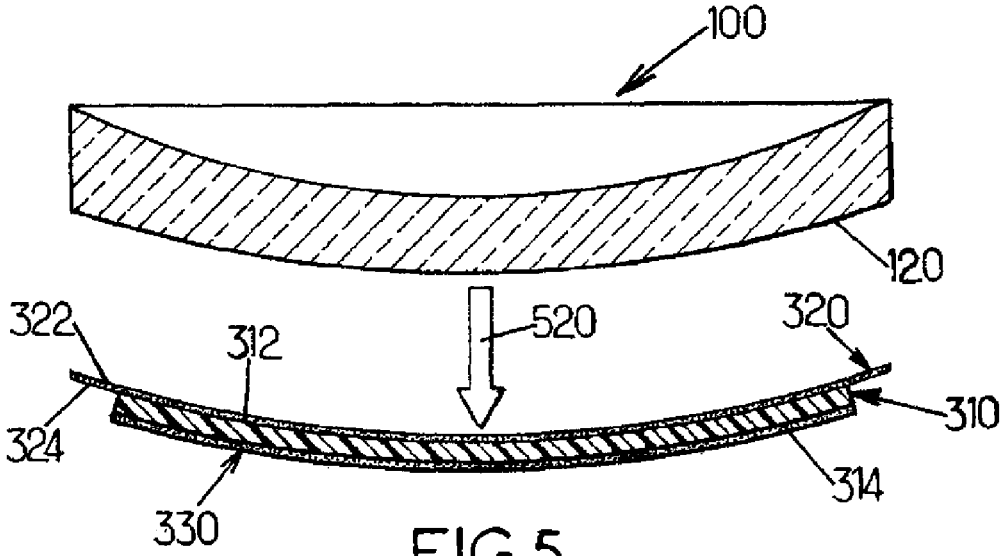

Consecutive deblocking steps of an embodiment of the invention are shown on FIGS. 3 to 5.

The holding unit 200 is heated through heating means 400 on FIG. 3. Heating means can be for example IR or UV lamps, as well as hot liquids, and provided by contacting a heated metal part or by other conductive heating means.

According to an embodiment, only the bottom part of the holding unit 200, as for an example the lower part 230 of the bottom part, is directly heated by the heating means and the heat propagates then through the holding unit to the upper part 250 thanks to heat conduction.

It is thus possible to control precisely the heat amount brought to the layer of thermoplastic material 310 and to avoid thermal shock on the optical lens 100. Optical quality of the optical lens can thus be advantageously preserved.

Heating the holding unit 200 makes possible to deblock the optical lens without significant heating of the optical lens.

After heating the bottom surface 314 of the thermoplastic material layer 310 thanks to conductive heating through the holding unit 200, a zone of thermoplastic material close to said surface 314 melts or softens.

According to a further step illustrated on FIG. 4, the pins 261 are moved through the holes 260 in the lens holding block 200 to contact the thermoplastic layer via the adhesive tape 330. A pushing force is applied by the pins 261 by further moving the pins 261 trough the holes 260 to push the ophthalmic lens component via the thermoplastic layer.

The ophthalmic lens component 100 and the fixing means 300 consisting of the first layer of adhesive tape 330, the thermoplastic layer 310 and the third layer of the adhesive tape 320, remain together.

According to a further step illustrated on FIG. 5, the third layer consisting of the adhesive tape 320 is peeled or pulled according to arrow 520 and the third layer, the thermoplastic material layer and the first layer of adhesive tape 330 remain together after being separated from the ophthalmic lens component 100.

The lens holding block can be rapidly reused to prepare another lens blocking device.

Thanks to the adhesive tapes the thermoplastic material as well as the lens holing unit are not contaminated during the blocking/machining/deblocking steps and are immediately reusable.

The invention has been described above with the aid of embodiments without limitation of the general inventive concept. In particular the present invention provides a method for blocking and/or deblocking all kinds of optical lenses, particularly ophthalmic lenses, e.g. single vision (spherical, torical), bi-focal, progressive, aspherical lenses (etc.), semi-finished optical lenses and/or blanks, blanks for manufacturing optical lenses.

The invention claimed is:

1. A method of deblocking an ophthalmic lens component blocked on a thermoplastic layer comprising:

arranging the thermoplastic layer on a holding surface of a lens holding block; and applying a pushing force on the thermoplastic layer, wherein the pushing force is greater or equal to 100 N and smaller or equal to 1000 N and wherein the pushing force is applied in a region of the thermoplastic layer situated at a distance of at least 17.5 mm from a fitting point or a prism reference point of the ophthalmic lens component.

2. The method according to claim 1, wherein the method further comprises: prior to or when applying the pushing force, warming the thermoplastic layer at a temperature greater or equal to 30° C. and smaller or equal to 70° C.

3. The method according to claim 1, wherein the pushing force is applied on the thermoplastic layer so that a moment applied to the ophthalmic lens component smaller or equal to 3.5 Nm.

4. The method according to claim 1 wherein the pushing force is obtained by moving at least one pin through at least one hole in the lens holding block to contact the thermoplastic layer and by further moving the pin to push the thermoplastic layer.

5. The method according to claim 1 wherein the pushing force is obtained by moving the lens holding block so as to have at least one pin enter into at least one hole in the lens holding block to contact the thermoplastic layer and by further moving the lens holding block to push the thermoplastic layer.

6. The method according to claim 1, wherein the ophthalmic lens component is a sole ophthalmic lens blank or the ophthalmic lens component is a lens blank and a coating or tape applied to the ophthalmic lens blank surface close to the thermoplastic layer.

7. The method according to claim 1 wherein a tape is placed between the thermoplastic layer and the holding surface of a lens holding block.

8. The method according to claim 1, wherein the melting or softening point of the thermoplastic of the thermoplastic layer is greater or equal to 35° C. and smaller or equal to 75° C.

9. A method of machining a lens component comprising the steps of:

providing a lens holding block and a thermoplastic layer;

heating the thermoplastic layer to a temperature at which at least a part of the thermoplastics flows under moderate pressure;

placing the ophthalmic lens component onto the thermoplastic layer;

allowing the thermoplastic layer flown part to solidify, thereby adhering the ophthalmic lens component;

machining the ophthalmic lens component; and deblocking the ophthalmic lens component according to the method of claim 1.

10. A lens blocking device comprising:

a lens holding block having a thermoplastic layer configured to have an ophthalmic lens component blocked on it, and at least one hole positioned at least 17.5 mm from a center of the lens holding block;

at least one pin arranged to be entered in the hole of the lens holding block to apply a force greater or equal to 100 N and smaller or equal to 1000 N to the thermoplastic layer.

11. The lens blocking device of claim 10, wherein the lens holding block comprises three holes placed at equal distances from the center of the lens holding block and equally spaced one from another, and wherein the distance between each of the three holes and the center of the lens holding block is greater or equal to 20 mm.

12. The lens blocking device of claim 10, wherein the distance between the at least one hole and the center of the lens holding block is smaller or equal to 24 mm.

13. The lens blocking device of claim 10, wherein the at least one hole has a cylindrical shape and a diameter greater or equal to 3 mm and smaller or equal to 5 mm.

14. The lens blocking device of claim 10, wherein the melting or softening point of the thermoplastic of the thermoplastic layer is greater or equal to 35° C. and smaller or equal to 75° C.

* * * * *